US012369767B1

(12) United States Patent
Cheng et al.

(10) Patent No.: US 12,369,767 B1
(45) Date of Patent: Jul. 29, 2025

(54) CLEANING ROBOT DOCKING STATION AND CLEANING SYSTEM WITH CLEANING ROBOT DOCKING STATION

(71) Applicant: TP-Link Systems Inc., Irvine, CA (US)

(72) Inventors: Ning Cheng, Shenzhen (CN); Yuhong Hu, Shenzhen (CN); Feixiang Mei, Shenzhen (CN); Chunlin Xu, Shenzhen (CN)

(73) Assignee: TP-Link Systems Inc., Irvine, CA (US)

( * ) Notice: Subject to any disclaimer, the term of this patent is extended or adjusted under 35 U.S.C. 154(b) by 0 days.

(21) Appl. No.: 19/063,093

(22) Filed: Feb. 25, 2025

(51) Int. Cl.
*A47L 11/03* (2006.01)
*A47L 11/40* (2006.01)

(52) U.S. Cl.
CPC ..... *A47L 11/4091* (2013.01); *A47L 2201/028* (2013.01)

(58) Field of Classification Search
CPC ..... A47L 11/4091; A47L 2201/028; A47L 11/29; A47L 11/4013; A47L 11/4016; B01D 53/265; B01D 1/0082; C02F 1/02; C02F 1/04
See application file for complete search history.

(56) References Cited

FOREIGN PATENT DOCUMENTS

| | | | | |
|---|---|---|---|---|
| CN | 215605455 U | | 1/2022 | |
| CN | 115399702 A | * | 11/2022 | ..... A47L 11/4022 |
| CN | 115500752 A | | 12/2022 | |
| CN | 115555381 A | | 1/2023 | |
| EP | 3284383 A2 | * | 2/2018 | ..... A47L 11/4022 |

OTHER PUBLICATIONS

English language machine translation of CN115500752A, 12 pages, No Date.*
English language machine translation of EP3284383A2, 8 pages, No Date.*

* cited by examiner

*Primary Examiner* — Pranav N Patel
(74) *Attorney, Agent, or Firm* — Loeb & Loeb LLP

(57) ABSTRACT

The present disclosure provides a cleaning robot docking station and a cleaning system with the cleaning robot docking station. The cleaning robot docking station includes an evaporation equipment, configured to evaporate liquid inside the evaporation equipment and expel a first gas. The cleaning robot docking station further includes a condensation equipment, configured to receive the first gas from the evaporation equipment, condense at least a part of the water vapor in the first gas, and expel a second gas. The first gas is pre-cooled before entering the condensation equipment.

18 Claims, 4 Drawing Sheets

CLEANING ROBOT DOCKING STATION AND CLEANING SYSTEM WITH CLEANING ROBOT DOCKING STATION

TECHNICAL FIELD

The present disclosure relates to a cleaning robot docking station and a cleaning system with the cleaning robot docking station.

BACKGROUND

Autonomous cleaning robots have gained widespread adoption across residential homes, offices, and industrial settings for their ability to perform sweeping and/or mopping tasks on various floor surfaces. These robots, commonly known as robotic vacuum cleaners or floor cleaners, are designed to autonomously navigate and clean designated areas before returning to their charging and docking stations. Upon completion of a cleaning cycle, the cleaning robot returns to the docking station, where it transfers the collected dry debris into a dustbin of the docking station and undergoes a cleaning process for its mopping pads.

There is a need for an improved mechanism for handling the wastewater generated from cleaning the mopping pads at the docking station to enhance the user experience.

SUMMARY

In view of the above problems, the present disclosure provides a cleaning robot docking station and a cleaning system equipped with the same.

According to an embodiment of the present disclosure, there is provided a cleaning robot docking station, which comprises: an evaporation equipment, configured to evaporate the liquid inside the evaporation equipment and expel a first gas; and a condensation equipment, configured to receive the first gas from the evaporation equipment and condense at least part of the water vapor in the first gas, and expel a second gas; wherein the first gas is pre-cooled before entering the condensation equipment.

According to another embodiment of the present disclosure, there is provided a cleaning system comprising a cleaning robot and a cleaning robot docking station, wherein the cleaning robot docking station comprises: an evaporation equipment, configured to evaporate the liquid inside the evaporation equipment and expel a first gas; and a condensation equipment, configured to receive the first gas from the evaporation equipment and condense at least part of the water vapor in the first gas, and expel a second gas; wherein the first gas is pre-cooled before entering the condensation equipment.

The following text will describe in more detail the preferred embodiment of the invention in this disclosure, in conjunction with the accompanying drawings, so as to easily understand the features and advantages of this disclosure.

BRIEF DESCRIPTION OF THE DRAWINGS

The above and other objects, features and advantages of the present disclosure will become more apparent by describing embodiments of the present disclosure in more detail in conjunction with accompanying drawings. The drawings are used to provide a further understanding of the embodiments of the present disclosure and constitute a part of the specification. The drawings together with the embodiments of the present disclosure are used to explain the present disclosure, but do not constitute a limitation on the present disclosure. In the drawings, unless otherwise explicitly indicated, the same reference numerals refer to the same components, steps or elements.

DETAILED DESCRIPTION

Figure 1:
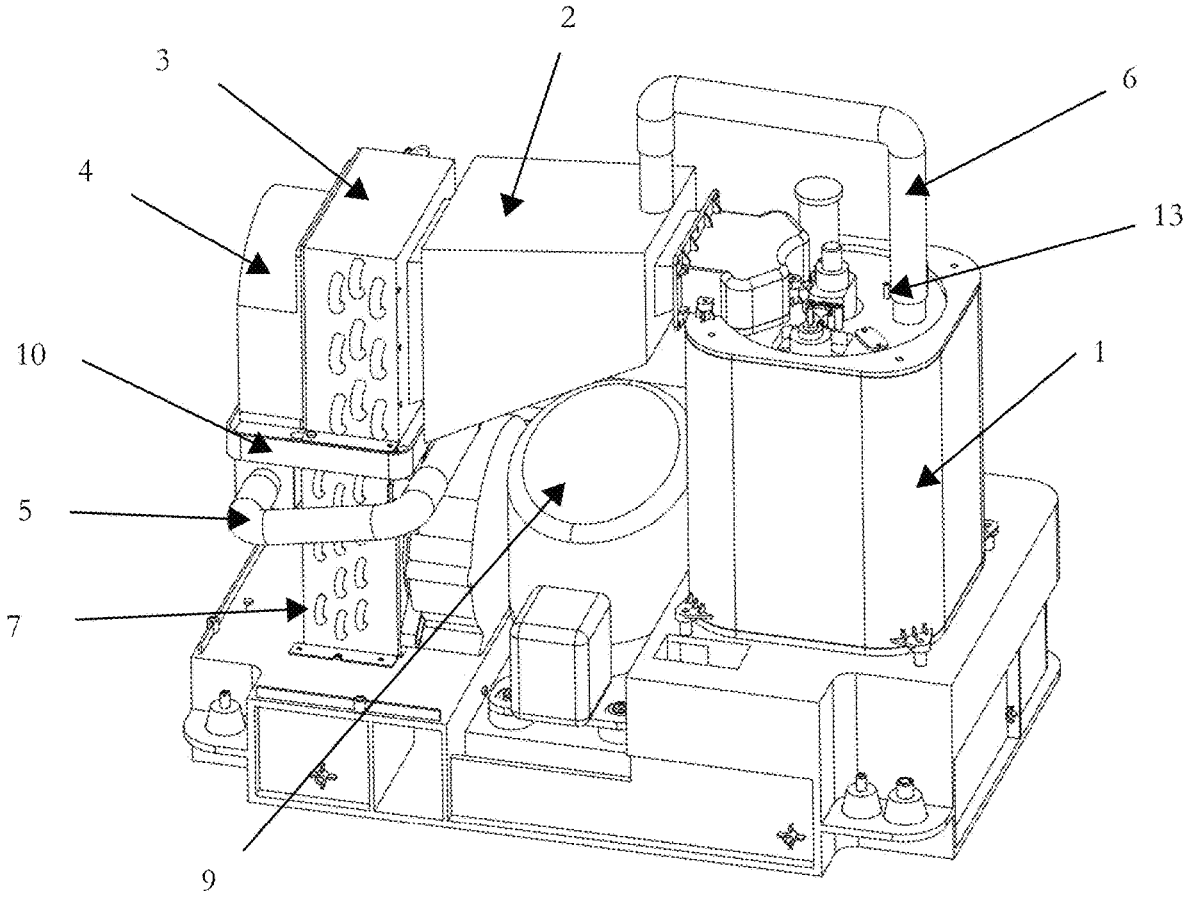
FIG. 1 illustrates a schematic diagram of a cleaning robot station according to an exemplary embodiment of the present disclosure.

The technical solution of the present disclosure will be clearly and completely described below in conjunction with accompanying drawings. Obviously, the described embodiments are part of embodiments of the present disclosure, but not all of them. Based on the embodiments in the present disclosure, all other embodiments obtained by ordinary skilled in the art without making any creative efforts fall within the scope of protection of the present disclosure.

In the description of the present disclosure, it should be noted that orientations or positional relationships indicated by terms such as "center", "upper", "lower", "left", "right", "vertical", "horizontal", "top", "bottom", "internal", "external", "inside" and "outside" are based on orientations or positional relationships shown in the drawings, only for the convenience of describing the present disclosure and simplifying the description, instead of indicating or implying the indicated device or element must have a particular orientation. In addition, terms such as "first", "second" and "third" are only for descriptive purposes, and cannot be understood as indicating or implying relative importance. Likewise, words like "a", "an" or "the" do not represent a quantity limit, but represent an existence of at least one. Words like "include" or "comprise" mean that an element or an object in front of the said word encompasses those ones listed following the said word and their equivalents, without excluding other elements or objects. Words like "connect" or "link" are not limited to physical or mechanical connections, but may include electrical connections, whether direct or indirect connections.

In the description of the present disclosure, it should be noted that, unless otherwise explicitly specified and limited, terms such as "mount", "link" and "connect" should be understood in a broad sense. For example, such terms may refer to being fixedly connected, or detachably connected, or integrally connected; may refer to being mechanically connected, or electrically connected; may refer to being directly connected, or indirectly connected via an intermediate medium, or internally connected inside two elements. For ordinary skilled in the art, the meanings of the above terms in the present disclosure may be understood on a case-by-case basis.

In addition, technical features involved in different embodiments of the present disclosure may be combined with each other as long as no conflicts occurs therebetween.

Traditional solutions for docking stations of autonomous cleaning robots, aiming to facilitate user convenience by eliminating the need for clean water replacement and wastewater discharge, have often relied on the installation of complex plumbing systems. These systems automate the process of replenishing clean water and discharging wastewater. However, a significant limitation is the requirement for suitable installation sites with appropriate piping and space, which many households lack, thus preventing the installation of such systems.

Common cleaning robot docking stations on the market often have an integrated clean water tank and a dirty water tank. The clean water tank sprays clean water to wash the mop, and the dirty water pump sucks the dirty water generated from washing the mop into the dirty water tank for storage. This structure has several issues: first, it requires manual replenishment of clean water and disposal of dirty water every once in a while, which is troublesome for users; second, the dirty water stored in the dirty water tank for a long time is prone to odor, and the user experience is poor when cleaning the dirty water tank.

There are also cleaning robot docking stations equipped with wastewater treatment capabilities. Such cleaning robot docking stations generally have two issues: one is high power consumption; the other is that if the dirty water contains some substances with low boiling points and odors, the gas expelled after condensation will also have a certain odor, which affects the user experience.

There is a need to effectively improve the conversion rate of water vapor to liquid water, reduce the refrigeration power required for the liquefaction of water, and eliminate the odor caused by condensation exhaust gases, all in a cost-effective manner.

To overcome these challenges, the present disclosure proposes an improved solution for docking stations of autonomous cleaning robots that automatically handles wastewater and generates clean water, enabling an effective water recycle.

In the existing methods of wastewater treatment, the gas mixed with water vapor after evaporation is guided to the condensation equipment and liquefied after encountering the low-temperature surface of the condensation equipment. However, due to the short contact time and small contact area between the water vapor and the low-temperature surface of the condensation equipment, some of the water vapor fails to cool and liquefy. In particular, when the refrigeration power of the condensation equipment's compressor is low, the liquefaction rate of the water vapor will be even lower, thus requiring a higher refrigeration power cooling system. However, a higher refrigeration power cooling system leads to high energy consumption. In addition, the gas coming out of the condensation equipment will also contain odors, which may cause discomfort to users when released into the air.

To improve the conversion rate of water vapor to liquid water, reduce the refrigeration power required for liquefaction, and eliminate the odors from the condensation exhaust gas, the present disclosure proposes a solution. The following will describe the solution and its preferred features in conjunction with the accompanying drawings.

According to the embodiment of the present disclosure, the cleaning robot docking station includes evaporation equipment. The evaporation equipment is configured to evaporate the liquid inside the evaporation equipment and expel a gas with water vapor. The evaporation equipment may take various forms. In the preferred embodiment shown in the accompanying drawings, the evaporation equipment has an evaporating dish 1 for holding the liquid and a heater for heating the liquid in the evaporating dish 1. The liquid held in the evaporating dish 1 is, for example, wastewater collected from the cleaning robot after completing the current cleaning cycle and docking at the cleaning robot docking station. The wastewater in the evaporating dish 1 may be distilled to produce clean water, which may later be stored in a clean water tank (not shown) of the cleaning robot docking station, and/or supplied to the cleaning robot for the next cleaning cycle.

In the embodiment shown in the accompanying drawings, the evaporating dish 1 is a roughly cylindrical container. However, in other embodiments not shown, the evaporating dish 1 may have other structural forms, such as a box shape, a cubic shape, an irregular shape, etc.

The heater of the evaporation equipment may be, for example, set in a heating chamber located below the evaporating dish 1, to heat the liquid in the evaporating dish 1 to evaporate. The evaporated gas may enter the condensation equipment of the cleaning robot docking station through a gas guide component and obtain pure liquid water through condensation.

For the sake of explanation, the gas expelled from the evaporation equipment in this text is referred to as the first gas, which is rich in water vapor and will go to the condensation equipment for condensation to produce pure liquid water, achieving the water-making function. The condensation equipment receives the first gas from the evaporation equipment, condenses at least some of the water vapor in the first gas, and expels the remaining gas. The gas expelled from the condensation equipment in this text is referred to as a second gas.

The condensation equipment of the cleaning robot docking station may be any equipment that may condense the water vapor in the first gas. The condensation equipment provides a relatively cold surface, and condensation occurs when the first gas comes into contact with this low-temperature surface.

In the preferred embodiment shown in the accompanying drawings, the condensation equipment is equipped with a refrigerant cycle system, which includes a compressor 9, an evaporator 3, and a condenser 7 to achieve refrigeration. The low-pressure and low-temperature refrigerant liquid can, for example, evaporates in the evaporator 3, absorbing the surrounding environment's heat, thereby reducing the temperature of the evaporator 3 and achieving refrigeration. The compressor 9 is the power source of the refrigerant cycle system and may be used, for example, to compress the low-pressure refrigerant vapor generated in the evaporator 3 into high-pressure hot vapor, while increasing its temperature and pressure, providing power for the entire cycle. The condenser 7 may release the heat from the high-pressure hot vapor output by the compressor, causing it to liquefy. As shown in FIG. 1, preferably, the evaporator 3 used for refrigerants is the condensation equipment mentioned earlier. Since the refrigerant liquid evaporates in the evaporator 3, the evaporator 3 may provide a low-temperature surface, and the water vapor in the first gas condenses due to the cooling of this low-temperature surface.

To improve the conversion rate of water vapor to liquid water and reduce the refrigeration power required for liquefaction, the present disclosure proposes that the first gas be pre-cooled before entering the condensation equipment. By pre-cooling, some of the water vapor in the first gas may be converted to liquid water in advance, thereby improving the conversion rate of water vapor condensation to liquid water and reducing the refrigeration power required for liquefaction.

Figure 2:
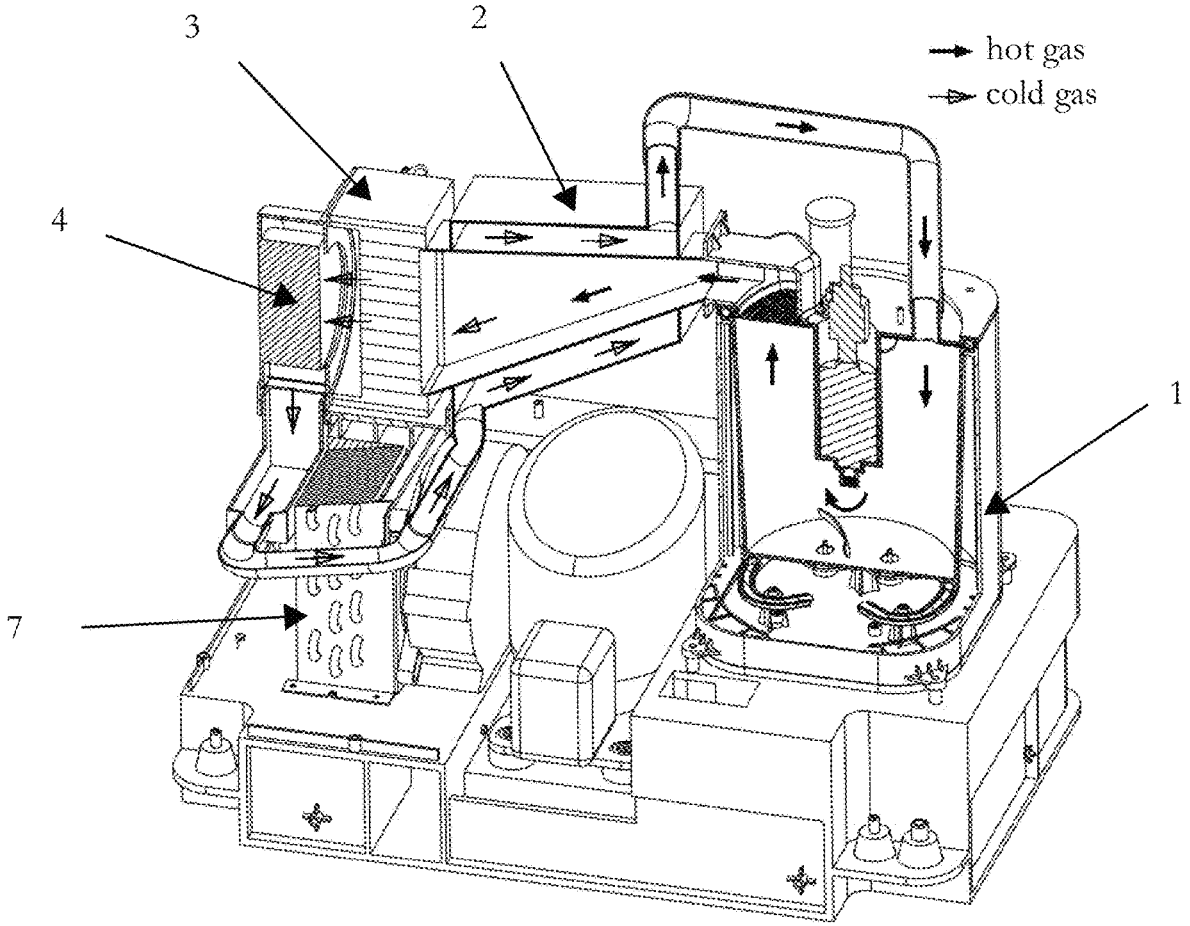
FIG. 2 illustrates a gas flow circulation diagram of a cleaning robot station according to an exemplary embodiment of the present disclosure.

In the preferred embodiment shown in the accompanying drawings, pre-cooling is achieved with the help of the second gas. In other words, the cleaning robot docking station is configured such that during its gas circulation process the first gas is pre-cooled by the second gas before entering the condensation equipment. The second gas is the gas that has been cooled and dried after passing through the condensation equipment, and its temperature is significantly lower than that of the first gas, so it may be used to cool the first gas. To facilitate heat exchange between the first gas and the second gas, the present disclosure designs a condensation tube 2 with a special structure, which is located between the evaporation equipment and the condensation equipment, and the first gas from the evaporation equipment enters the condensation equipment through the condensation tube 2. Preferably, the second gas expelled from the condensation equipment may also return to the evaporation equipment through the condensation tube 2. FIGS. 1 and 2 show the position of the condensation tube 2 in the cleaning robot docking station, and FIGS. 3 and 4 show the specific structure of the condensation tube 2.

Overall, the condensation tube 2 includes a first gas-guiding section and a second gas-guiding section, which are used to guide the first gas and the second gas, respectively. Specifically, the first gas from the evaporation equipment enters the condensation equipment through the first gas-guiding section, and the second gas from the condensation equipment returns to the evaporation equipment through the second gas-guiding section. The first gas and the second gas may undergo heat exchange in the condensation tube 2.

Preferably, the first gas-guiding section and the second gas-guiding section are separated by a single-layer partition wall 23. In this way, the first gas in the first gas-guiding section and the second gas in the second gas-guiding section may exchange heat through only one partition wall 23, thereby achieving effective pre-cooling of the first gas.

Figure 3:
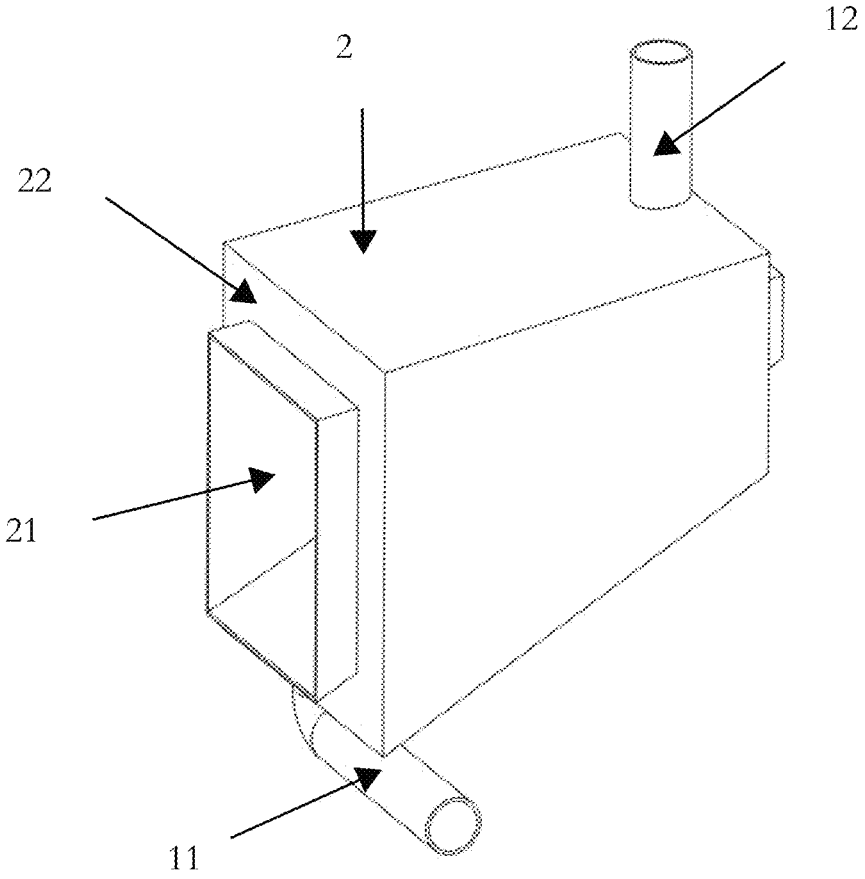
FIG. 3 illustrates a schematic diagram of a condensation tube of a cleaning robot station according to an exemplary embodiment of the present disclosure.
Figure 4:
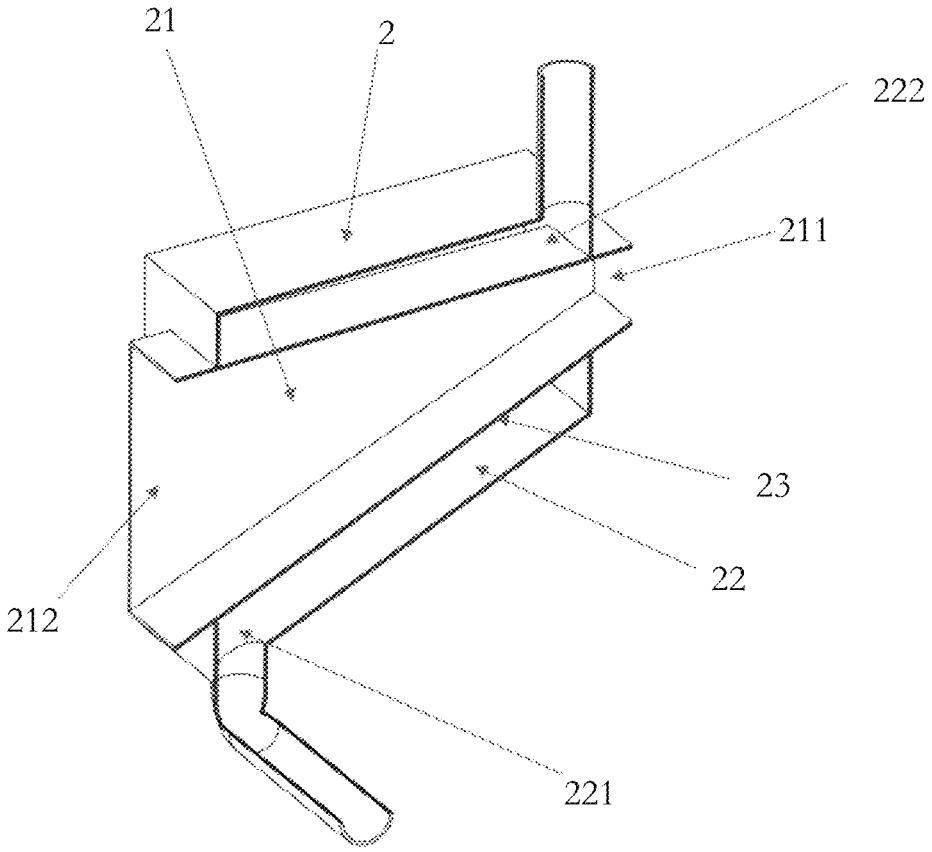
FIG. 4 illustrates a cross-sectional view of a condensation tube of a cleaning robot station according to an exemplary embodiment of the present disclosure.

Preferably, as shown in FIG. 3, the first gas-guiding section and the second gas-guiding section are configured as an inner chamber 21 and an outer chamber 22, respectively, with the outer chamber 22 surrounding the inner chamber 21. Such a 360° surrounding structure may improve heat exchange efficiency and is conducive to full pre-cooling of the first gas.

In other embodiments not shown, the first gas-guiding section and the second gas-guiding section may be arranged in other ways. For example, the first gas-guiding section and the second gas-guiding section may be arranged side by side. For example, the first gas-guiding section and the second gas-guiding section may be two parallel channels separated by a single-layer partition wall. Alternatively, the first gas-guiding section and the second gas-guiding section may be arranged in an interwoven manner (e.g., coiled together), etc.

As shown in FIGS. 3 and 4, the inner chamber 21 is formed by a top wall, a bottom wall, and two side walls located between the top and bottom walls. Preferably, the bottom wall of the inner chamber 21 may be inclined, and its inclination direction allows the condensate droplets to be guided towards the condensation equipment. As shown in the figures, the inclined bottom wall is lower at the end near the condensation equipment than at the end near the evaporation equipment, and the droplets formed by the condensation of water vapor in the first gas may be guided towards the condensation equipment by the inclined bottom wall.

It is understood that in other embodiments not shown, the inner chamber 21 may have other forms, such as having a circular, elliptical, square, rectangular, or irregular cross-section. The bottom wall of the inner chamber 21 is the wall located at the bottom of the inner chamber 21, which may receive condensate. The bottom wall does not have to be a flat wall but may have other forms, such as a curved shape or an arc shape.

Preferably, as shown in FIG. 4, the inner chamber inlet 211 may be smaller in size than the inner chamber outlet 212. Preferably, the cross-section of the inner chamber 21 tapers towards the evaporation equipment. In this way, when the hot gas from the evaporation equipment enters the inner chamber 21 of the condensation tube 2, the gas flow speed and temperature decrease due to the increased flow area, which is conducive to the condensation and liquefaction of water vapor.

As shown in FIG. 1 or FIG. 2, preferably, the cleaning robot docking station has a first connecting duct 5 connected between the condensation equipment and the condensation tube 2. The first connecting duct 5, for example, is in the form of a circular pipe, which may guide the second gas from the condensation equipment to the condensation tube 2. The first connecting duct 5 may be a single pipe or include multiple independent pipes joined together. In addition, the first connecting duct 5 may have one or more straight sections and/or one or more turning sections.

As shown in FIG. 1 or FIG. 2, preferably, the cleaning robot docking station has a second connecting duct 6 connected between the evaporation equipment and the condensation tube 2. The second connecting duct 6, for example, is in the form of a circular pipe, which may guide the first gas from the condensation equipment to the condensation tube 2. The second connecting duct 6 may be a single pipe or include multiple independent pipes joined together. In addition, the second connecting duct 6 may have one or more straight sections and/or one or more turning sections.

Preferably, as shown in FIGS. 1, 2, and 4, the condensation tube 2 also includes an outer chamber inlet interface 11 and an outer chamber outlet interface 12 that extend from the outer wall surface of the outer chamber and are connected to the outer chamber. The outer chamber inlet interface 11 and the outer chamber outlet interface 12 are preferably provided at the two opposite ends of the condensation tube 2. The outer chamber inlet interface 11 and the outer chamber outlet interface 12 are preferably tubular structures to facilitate connection with other pipes. The cross-section of the outer chamber inlet interface 11 and the outer chamber outlet interface 12 may be circular, elliptical, etc. The outer chamber inlet interface 11 and the outer chamber outlet interface 12 are preferably perpendicular to the outer wall surface of the outer chamber. The outer chamber inlet interface 11 and the outer chamber outlet interface 12 are preferably in the form of a round pipe, and the cross-sectional size of the round pipe may be significantly smaller than the cross-sectional size of the outer chamber 22 of the condensation tube.

The outer chamber inlet interface 11 may be connected to the first connecting duct 5, and the outer chamber outlet interface 12 may be connected to the second connecting duct 6, so that the second gas flowing out of the condensation equipment may enter the outer chamber 22 of the condensation tube through the first connecting duct 5 and the outer chamber inlet 221, and then enter the second connecting duct 6 through the outer chamber outlet 222 of the condensation tube, and then guided into the evaporating dish 1 through the second connecting duct 6, as shown by the arrow in FIG. 2.

As shown in FIG. 1 or FIG. 2, preferably, the evaporation equipment has a gas valve 13. In response to the pressure difference caused by temperature changes and/or changes in the liquid level in the evaporating dish 1 reaches a threshold, the gas valve 13 may be opened to connect to the atmosphere and balance the pressure. As shown in FIG. 1 or FIG. 2, the gas valve 13 is set on the top of the evaporating dish 1. However, the gas valve 13 may also be set in other positions, such as in the first connecting duct 5 or the second connecting duct 6, as long as it may balance the gas pressure in the gas flow cycle path and the external atmospheric pressure. The gas valve 13 may be in the form of a small hole or a separate valve.

Understandably, the process of generating clean water by the clean water generation device through condensation may result in the formation of water droplets. To optimize this process, it is preferable to have a water receiving vessel, such as a tray or a basin in place to collect these purified water droplets initially. This water receiving vessel may serve as an intermediary container where the condensate is first gathered. Once the water in the tray accumulates to a certain level, it may then be pumped into the clean water tank.

As shown in FIG. 1 or FIG. 2, preferably, the cleaning robot docking station has an exhaust fan 4, which is configured to draw the first gas to the condensation equipment.

The following describes the gas flow circulation of the cleaning robot docking station according to the exemplary embodiment of this disclosure in conjunction with FIG. 2. In FIGS. 2-3, solid arrows represent gases with relatively high temperatures, and hollow arrows represent gases with relatively low temperatures. For example, the gas coming out of the evaporating dish 1 is a high-temperature gas, and thus is represented by a solid arrow. The airflow in the inner chamber 21 of the condensation tube 2 near the inner chamber inlet 211 has a relatively high temperature, and thus is represented by a solid arrow. The airflow in the inner chamber of the condensation tube 2 near the inner chamber outlet 212 has a lower temperature due to pre-cooling, and thus is represented by a hollow arrow. The gas cooled by the condensation equipment is a low-temperature gas, and thus is represented by a hollow arrow.

As shown in FIGS. 2-3, the heater below the evaporating dish 1 heats the liquid in the evaporating dish 1 (for example, wastewater from washing rags). Affected by the negative pressure caused by the exhaust fan 4, the high-temperature first gas rich in water vapor from the evaporating dish 1 enters the condensation tube 2 through the outlet of the evaporating dish 1 and travels along the condensation tube 2. The first gas comes into contact with the low-temperature evaporator 3 at the outlet of the condensation tube 2, resulting in the liquefaction of some of the water vapor in the first gas, which flows into the water collection container 10 below the evaporator 3. The remaining dry low-temperature gas after being expelled from the evaporator 3 (referred to as the second gas) enters the outer chamber inlet 221 of the condensation tube through the first connecting duct 5, thus, the cold second gas fills the entire outer chamber 22 of the condensation tube, and cools the first gas entering the inner chamber 21 of the condensation tube from the inner chamber inlet 211. Some of the water vapor in the first gas liquefies, and the liquefied droplets flow along the inclined bottom wall towards the evaporator 3 and are ultimately collected by the water collection container 10. Among them, the temperature and humidity of the gas closer to the inner chamber outlet 212 of the condensation tube will be lower. The pre-cooled and dehumidified first gas reaches the low-temperature evaporator 3, and the water vapor in it is further cooled and liquefied, achieving a high conversion rate from water vapor to liquid water. Meanwhile, the second gas in the outer chamber 22 of the condensation tube absorbs heat as it travels from the outer chamber inlet 221 to the outer chamber outlet 222 and returns to the evaporating dish 1 through the second connecting duct 6, forming an internal gas circulation. The second gas, as a dry airflow, accelerates the evaporation rate of the liquid surface in the evaporating dish 1 after entering it.

In the present disclosure, the cold waste gas cooled and dried by the condensation equipment is used to pre-cool and pre-condense the water vapor expelled from the evaporating dish 1 in the condensation tube, thereby increasing the conversion rate of water vapor to condensate and reducing the power consumption required by the refrigeration system.

Furthermore, in the present disclosure, the cold waste gas used for pre-cooling is reused by being reintroduced into the evaporating dish 1, forming a gas convection that is conducive to accelerating evaporation in the evaporating dish, while avoiding the direct discharge of cold waste gas into the environment, which may cause odors.

The present disclosure also relates to a cleaning system with a cleaning robot and a robot station. In the cleaning system, the cleaning robot may perform cleaning tasks for users, such as sweeping and/or mopping tasks on various floor surfaces. Accordingly, the docking station may provide docking functions for the cleaning robot, such as recharging the battery of the cleaning robot, collecting dry debris from the cleaning robot into a dustbin of the docking station, and performing a cleaning process for the mopping pads of the cleaning robot. Details of the structure of the cleaning robot are known to those skilled in the art and are omitted herein.

According to one aspect of the present disclosure, there is provided a cleaning robot docking station, which comprises: an evaporation equipment, configured to evaporate the liquid inside the evaporation equipment and expel a first gas; and a condensation equipment, configured to receive the first gas from the evaporation equipment and condense at least part of the water vapor in the first gas, and expel a second gas; wherein the first gas is pre-cooled before entering the condensation equipment.

According to one embodiment of the cleaning robot docking station of the present disclosure, the cleaning robot docking station is configured such that during its gas circulation process the first gas is pre-cooled by the second gas before entering the condensation equipment.

According to one embodiment of the cleaning robot docking station of the present disclosure, a condensation tube is arranged between the evaporation equipment and the condensation equipment, and the first gas from the evaporation equipment enters the condensation equipment through the condensation tube.

According to one embodiment of the cleaning robot docking station of the present disclosure, the condensation tube includes a first gas-guiding section and a second gas-guiding section, and the first gas enters the condensation equipment through the first gas-guiding section, and the second gas goes to the evaporation equipment through the second gas-guiding section.

According to one embodiment of the cleaning robot docking station of the present disclosure, the first gas-guiding section and the second gas-guiding section are separated by a single-layer partition wall.

According to one embodiment of the cleaning robot docking station of the present disclosure, the first gas-guiding section and the second gas-guiding section are arranged side by side.

According to one embodiment of the cleaning robot docking station of the present disclosure, the first gas-guiding section and the second gas-guiding section are arranged in an interwoven manner.

According to one embodiment of the cleaning robot docking station of the present disclosure, the first gas-guiding section and the second gas-guiding section are an inner chamber and an outer chamber, respectively, with the outer chamber surrounding the inner chamber.

According to one embodiment of the cleaning robot docking station of the present disclosure, the inner chamber inlet is smaller in size than the inner chamber outlet.

According to one embodiment of the cleaning robot docking station of the present disclosure, the inner chamber has an inclined bottom wall, which is arranged to guide the condensate droplets towards the condensation equipment.

According to one embodiment of the cleaning robot docking station of the present disclosure, the condensation tube also includes a tubular outer chamber inlet interface and a tubular outer chamber outlet interface that extend from the outer wall surface of the outer chamber and are connected to the outer chamber.

According to one embodiment of the cleaning robot docking station of the present disclosure, the cleaning robot docking station also has an exhaust fan, which is configured to draw the first gas to the condensation equipment.

According to one embodiment of the cleaning robot docking station of the present disclosure, the condensation equipment is an evaporator used for refrigerants.

According to one embodiment of the cleaning robot docking station of the present disclosure, the cleaning robot docking station has a first connecting duct connected between the condensation equipment and the condensation tube.

According to one embodiment of the cleaning robot docking station of the present disclosure, the cleaning robot docking station has a second connecting duct connected between the evaporation equipment and the condensation tube.

According to one embodiment of the cleaning robot docking station of the present disclosure, the cleaning robot docking station has a water collection container located below the condensation equipment.

According to one embodiment of the cleaning robot docking station of the present disclosure, the evaporation equipment has a gas valve, which is configured to open when the pressure difference between the pressure inside the evaporation equipment and the external atmospheric pressure reaches a threshold.

According to one embodiment of the cleaning robot docking station of the present disclosure, the evaporation equipment has an evaporating dish, and the gas valve is set on the top of the evaporation equipment's evaporating dish.

According to another aspect of the present disclosure, there is provided a cleaning system comprising a cleaning robot and a cleaning robot docking station, wherein the cleaning robot docking station comprises: an evaporation equipment, configured to evaporate the liquid inside the evaporation equipment and expel a first gas; and a condensation equipment, configured to receive the first gas from the evaporation equipment and condense at least part of the water vapor in the first gas, and expel a second gas; wherein the first gas is pre-cooled before entering the condensation equipment.

According to one embodiment of the cleaning system of the present disclosure, the cleaning robot docking station is configured such that during its gas circulation process the first gas is pre-cooled by the second gas before entering the condensation equipment.

The above describes the exemplary embodiment of the solution proposed in this disclosure in detail with reference to the preferred embodiment. However, those skilled in the field will understand that various modifications and variations may be made to the above-specific embodiment without departing from the concept of this disclosure, and various technical features and structures proposed in this disclosure may be combined in various ways without exceeding the scope of protection of this disclosure, which is determined by the appended claims.

Expression such as "according to", "based on", "dependent on", and so on as used in the disclosure does not mean "according only to", "based only on", or "dependent only on", unless it is explicitly otherwise stated. In other words, such expression generally means "according at least to", "based at least on", or "dependent at least on" in the disclosure.

Any reference in the disclosure to an element using the designation "first", "second" and so forth is not intended to comprehensively limit the number or order of such elements. These expressions may be used in the disclosure as a convenient method for distinguishing two or more units. Thus, a reference to a first unit and a second unit does not imply that only two units may be employed or that the first unit must precede the second unit in some form.

The term "determining" used in the disclosure may include various operations. For example, regarding "determining", calculating, computing, processing, deriving, investigating, looking up (e.g., looking up in tables, databases, or other data structure), ascertaining, and so forth are regarded as "determination". In addition, regarding "determining", receiving (for example, receiving information), transmitting (for example, transmitting information), input, output, accessing (for example, access to data in the memory), and so forth, are also regarded as "determining". In addition, regarding "determining", resolving, selecting, choosing, establishing, comparing, and so forth may also be regarded as "determining". That is, regarding "determining", several actions may be regarded as "determining".

The terms such as "connected", "coupled" or any of their variants used in the disclosure refer to any connection or combination, direct or indirect, between two or more units, which may include the following situations: between two units that are "connected" or "coupled" with each other, there are one or more intermediate units. The coupling or connection between the units may be physical or logical, or may also be a combination of the two. As used in the disclosure, two units may be considered to be electrically connected through the use of one or more wires, cables, and/or printed, and as a number of non-limiting and non-exhaustive examples, and are "connected" or "coupled" with each other through the use of electromagnetic energy with wavelengths in a radio frequency region, the microwave region, and/or in the light (both visible and invisible) region, and so forth.

When used in the disclosure or the claims 'including", "comprising", and variations thereof, these terms are as open-ended as the term "having". Further, the term "or" used in the disclosure or in the claims is not an exclusive-or.

The present disclosure has been described in detail above, but it is obvious to those skilled in the art that the present disclosure is not limited to the embodiments described in the disclosure. The present disclosure may be implemented as a modified and changed form without departing from the spirit and scope of the present disclosure defined by the description of the claims. Therefore, the description in the disclosure is for illustration and does not have any limiting meaning to the present disclosure.

What is claimed is:

1. A cleaning robot docking station comprises:

an evaporation equipment, configured to evaporate liquid inside the evaporation equipment and expel a first gas;

a condensation equipment, configured to receive the first gas from the evaporation equipment, condense at least a part of water vapor in the first gas, and expel a second gas;

wherein the first gas is pre-cooled before entering the condensation equipment; and wherein the first gas is pre-cooled by the second gas before entering the condensation equipment.

2. The cleaning robot docking station according to claim 1, further comprising a condensation tube arranged between the evaporation equipment and the condensation equipment, wherein the first gas from the evaporation equipment enters the condensation equipment through the condensation tube.

3. The cleaning robot docking station according to claim 2, wherein, the condensation tube includes a first gas-guiding section and a second gas-guiding section, and the first gas enters the condensation equipment through the first gas-guiding section, and the second gas flows to the evaporation equipment through the second gas-guiding section.

4. The cleaning robot docking station according to claim 3, wherein, the first gas-guiding section and the second gas-guiding section are separated by a single-layer partition wall.

5. The cleaning robot docking station according to claim 3, wherein, the first gas-guiding section and the second gas-guiding section are arranged side by side.

6. The cleaning robot docking station according to claim 3, wherein, the first gas-guiding section and the second gas-guiding section are arranged in an interwoven manner.

7. The cleaning robot docking station according to claim 3, wherein, the first gas-guiding section and the second gas-guiding section comprise an inner chamber and an outer chamber, respectively, with the outer chamber surrounding the inner chamber.

8. The cleaning robot docking station according to claim 7, wherein, the inner chamber inlet is smaller in size than the inner chamber outlet.

9. The cleaning robot docking station according to claim 7, wherein, the inner chamber has an inclined bottom wall, which is arranged to guide the condensate droplets towards the condensation equipment.

10. The cleaning robot docking station according to claim 7, wherein, the condensation tube includes a tubular outer chamber inlet interface and a tubular outer chamber outlet interface extending from the outer wall surface of the outer chamber and are connected to the outer chamber.

11. The cleaning robot docking station according to claim 1, wherein, the cleaning robot docking station comprises an exhaust fan, wherein the exhaust fan is configured to draw the first gas to the condensation equipment.

12. The cleaning robot docking station according to claim 1, wherein, the condensation equipment comprises an evaporator for refrigerants.

13. The cleaning robot docking station according to claim 2, wherein, the cleaning robot docking station comprises a first connecting duct connected between the condensation equipment and the condensation tube.

14. The cleaning robot docking station according to claim 2, wherein, the cleaning robot docking station comprises a second connecting duct connected between the evaporation equipment and the condensation tube.

15. The cleaning robot docking station according to claim 1, wherein, the cleaning robot docking station comprises a water collection container located below the condensation equipment.

16. The cleaning robot docking station according to claim 1, wherein, the evaporation equipment comprises a gas valve, wherein the gas valve is configured to open in response to a pressure difference between a pressure inside the evaporation equipment and an external atmospheric pressure reaches a threshold.

17. The cleaning robot docking station according to claim 16, wherein, the evaporation equipment comprises an evaporating dish, and the gas valve is set on top of the evaporating dish.

18. A cleaning system comprising:

a cleaning robot; and a cleaning robot docking station, wherein the cleaning robot docking station comprises:

an evaporation equipment, configured to evaporate liquid inside the evaporation equipment and expel a first gas; and a condensation equipment, configured to receive the first gas from the evaporation equipment, condense at least a part of water vapor in the first gas, and expel a second gas;

wherein the first gas is pre-cooled before entering the condensation equipment; and wherein the first gas is pre-cooled by the second gas before entering the condensation equipment.

* * * * *